United States Patent [19]

Friedrichs et al.

[11] Patent Number: 4,655,488

[45] Date of Patent: Apr. 7, 1987

[54] SYSTEM FOR LATCHING A LEVELING DOOR

[75] Inventors: Manfred Friedrichs, Essen; Michael Bohm, Bochum, both of Fed. Rep. of Germany

[73] Assignee: Dr. C. Otto & Comp. G.m.b.H., Bochm, Fed. Rep. of Germany

[21] Appl. No.: 782,946

[22] Filed: Sep. 26, 1985

[30] Foreign Application Priority Data

Oct. 20, 1984 [DE] Fed. Rep. of Germany ..... 3438583

[51] Int. Cl.[4] ..... E05C 5/00; E05C 19/14

[52] U.S. Cl. ..... 292/66; 292/64; 292/256.75

[58] Field of Search ..... 292/256.75, 66, 64, 292/63, 69

[56] References Cited

U.S. PATENT DOCUMENTS

| | | | |
|---|---|---|---|
| 1,521,835 | 1/1925 | Reed | 292/63 |
| 1,570,621 | 1/1926 | Crum | 292/66 |
| 2,018,191 | 10/1935 | Schmidt | 292/66 |
| 3,628,817 | 12/1971 | Sheahan | 292/66 |
| 3,756,640 | 9/1973 | Johnson | 292/256.75 |
| 4,218,081 | 8/1980 | Johnson | 292/66 |
| 4,421,349 | 12/1983 | Greiert | 292/66 |

*Primary Examiner*—Henry E. Raduazo

*Attorney, Agent, or Firm*—Thomas H. Murray; Clifford A. Poff

[57] ABSTRACT

A latch assembly is disclosed for latching a leveling door used to close a leveling rod opening which is surrounded by a seal in a leveling box at the upper portion of a coke-oven door. The latching assembly includes spaced apart side flanges connected together at one of their ends by a cross web. The opposite ends of the flanges carry a rod which, in one embodiment, engage claws on arms extending from the leveling box and in a second embodiment the is pivotally connected with arms extending from the leveling box. In the first embodiment, an arm extends from a leveling door and forms a pivotal connection with retaining members that are in turn, secured to a spring plate. In the second embodiment, the arm extending from the leveling door has a claw which can releasably engage the pin supported by the retaining member in all embodiments between the spring palate and the cross web there is a compression spring and a pin which extends through the spring plate where the extended end portion is provided with a nut forming a stop member.

9 Claims, 6 Drawing Figures

SYSTEM FOR LATCHING A LEVELING DOOR

BACKGROUND OF THE INVENTION

This invention relates to apparatus for latching a leveling door in a leveling box for closing a leveling rod opening disposed at the top portion of a coke-oven door. More particularly, the apparatus of the present invention includes a latching bolt to engage latching claws at the side of the leveling door which is opposite a pivot used to pivotally support the leveling door on the leveling box. The leveling door is pressed against a frame with a peripheral seal means therebetween.

In prior art leveling door facilities, the closure for the leveling rod opening takes the form of a leveling door, a frame above the door, and a compression spring disposed between the frame and the door. The pressure produced by the spring which is centrally disposed is stressed by the closure element disposed on the side of the frame.

SUMMARY OF THE INVENTION

It is an object of the present invention to simplify the closure arrangement for a leveling door, and more particularly, to omit the frame conventionally provided to surround the door and to reduce the forces required to operate the leveling door.

According to the present invention, there is provided apparatus for latching a leveling door to close a leveling rod opening surrounded by a seal and a leveling box at the upper portion of a coke-oven door, the apparatus including the combination of a U-shaped latching means having a cross web joining together ends of spaced-apart side flanges, a spring plate movable between the flanges in a direction of the length thereof relative to the cross web, an actuating pin connected to the spring plate for extending through an aperture in the cross web, a stop plate threadedly engaged with an end of the actuating pin which projects from the spring plate, a compression spring extending between the spring plate and the cross web, a first arm extending from the leveling door, a first pin for interconnecting the firsrt arm and the spring plate, a second arm extending from the leveling box, and a second pin for interconnecting the second arm and the side flanges, one of the first and second arms having a locking claw for releasably engaging the pin thereof and the other of the first and second arms being pivotally connected by the pin thereof.

In one embodiment of the present invention, the pivot pin is disposed in a bearing means which is connected to an arm extending to the leveling door and the latching claws with which the latching bolt cooperates are secured to the leveling box. In this embodiment, the bearing means for the pivot pin takes the form of bores in the U-shaped latching means of which a cross web is the spring plate.

In a second embodiment of the present invention, the pivot pin is disposed in bearing means which is connected to an arm that is rigidly attached to the leveling box while the latching claw is secured to the leveling door to cooperate with the latching bolt. In this embodiment of the invention, the latching bolt is disposed at the free end of the U-shaped latching means where the cross web thereof is the spring plate.

A nut member can be embodied as a butterfly nut which is screw-threaded onto the free end of the actuating pin. According to another feature of the present invention, the web of the U-shaped latching means includes a pin which bridges the nut and serves for engagement with an actuating member operable to pivot the latching means about the pivot pin.

The latching apparatus according to the present invention embodies a simplified construction and provides for rapid and reliable latching and unlatching of the leveling door. The latching and unlatching operations can be carried out with the application of a greatly reduced force as compared with a force required for these operations in the past even when they are performed manually. The closure consists solely of a cover. A frame and a central pressing spring commonly used in the past are unnecessary and eliminated by the present invention. The spring which is used in the present invention can be designed for only half the latching force usually required.

These features and advantages of the present invention as well as others will be more fully understood when the following description of various embodiments of the present invention are read in light of the accompanying drawings, in which.

Figure 1:
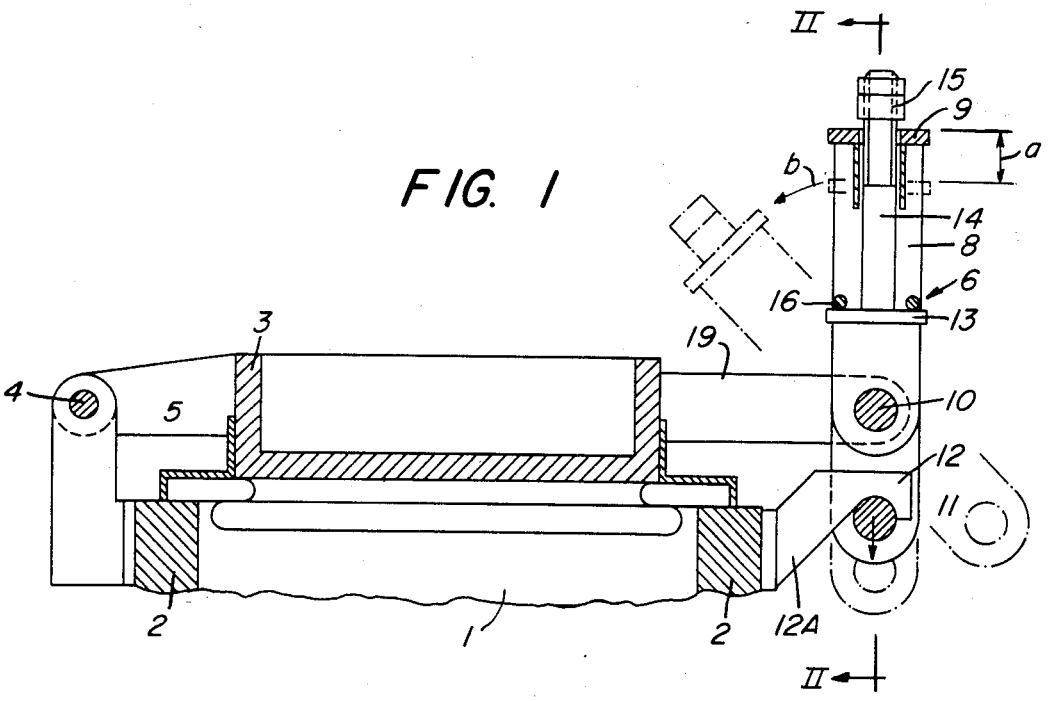
FIG. 1 is a sectional view taken through a leveling closure according to a first embodiment of the present invention.

In all embodiments of the leveling closure shown in FIGS. 1–6, there is provided at the upper portion of a coke-oven door, a leveling box 2 which extends around a leveling opening 1. A leveling door 3 is connected by a pivot 4 to the leveling box to pivot laterally from an open position into a closed position, the latter position of the door is shown in the drawings. Sealing means 5 are disposed between the leveling box 2 and the frame of the door 3. The door 3 is maintained in a closed position by a latching means 6, each embodiment of which includes a U-shaped member 7 comprised of two parallel arms or flanges 8 and a web 9 interconnecting the flanges at the top of the U-shaped member 7. In the embodiments of the present invention shown in FIGS. 1–4, the latching means further includes a non-displaceable bearing 17 for supporting a pivot pin 10 which is connected by an arm 19 to the leveling door. A displaceable latch bolt 11 is engaged with claws 12 on the extended ends of arms 12A that extend from the leveling box 2. The latch bolt 11 extends between flanges 8 and is supported thereby. A spring plate 13 extends between the flanges 8 for movement in a direction lengthwise of the flanges. An actuating pin 14 is connected at one end to plate 13 so that the pin extends generally parallel to flanges 8 through an aperture in the web 9. An extended end portion of the pin is provided with screw threads to receive a nut 15 in the embodiments of FIGS. 1 and 2 and jam nuts 15A in the embodiment of FIGS. 3 and 4 thereby acting as a stop member to counteract the upward force of spring 16. A compression spring 16 extends between the plate 13 and the web 9.

Figure 2:
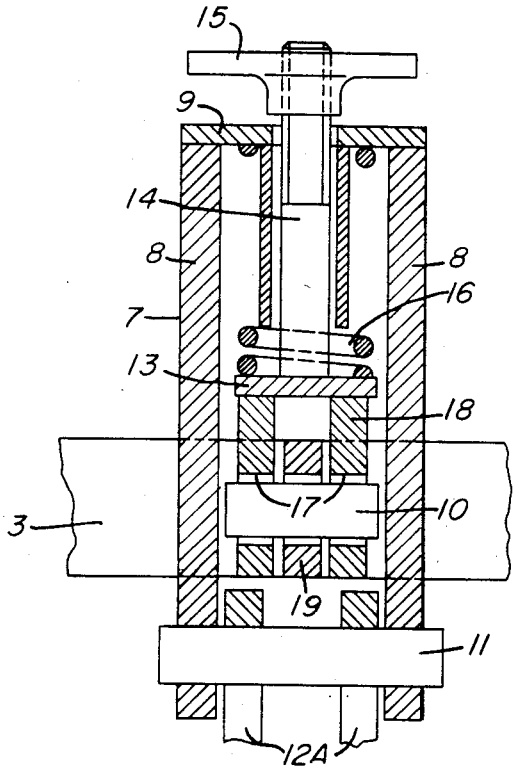
FIG. 2 is a sectional view taken along line II—II of FIG. 1.

In the embodiment of the present invention shown in FIGS. 1 and 2, the latching claws 12 are rigidly secured to the leveling box 2 and the latching bolt 11 is rigidly secured to the bottom ends of the flanges 8. As shown in FIG. 2, the bearing 17 for the pivot pin 10 takes the form of bores in the extended end portions of retainer plates 18 which are attached to plate 13. Arm 19, which extends from the leveling door 3, is provided with a bore at its extended end so that pin 10 can extend through the bore and through aligned bores in the extended ends of flanges 8. By this construction, a connection is provided between the latching means 6 and the door 3 whereby the latching means can pivot around pin 10 into a position shown by phantom lines in FIG. 1. In this embodiment, nut 15 takes the form of a butterfly nut which can be engaged by a suitable actuating element on the coke-pressing machine that moves along the coke-oven battery.

The operation of the apparatus of the present invention starts from the solid-line, latched position shown in FIG. 1 by rotating nut 15 so that it travels along the screw-threaded portion of pin 14 to press against the web 9 thereby acting as a stop member to counteract the upward force of spring 16 or, if desired, the web is pressed so that the web descends together with flanges 8 and latching bolt 11 in the direction indicated by arrow a. The nut 15 can be retained by appropriate means while pressure is applied to the web. Control devices can take the form of tongs or the like having claws which are introduced from both sides into a wedge-shaped gap having surfaces disposed to engage on the nut 15 and on the web 9. After the bolt 11 has been disengaged from the claws 12, the latching means 6 are pivoted about pin 10 in a direction indicated by arrow b so that the door 3 can be opened. The latching process proceeds in the reverse order with the latching means 6 first pivoted from the phantom-line position into a position where bolt 11 directly confronts the downwardly-directed retaining surfaces on claws 12. Thereafter, the nut 15 can be rotated in a direction for withdrawal toward the end of the pin 14 so that the latching bolt 11 is forced by operation of a spring 16 and members 8 against the claws 12.

Figure 3:
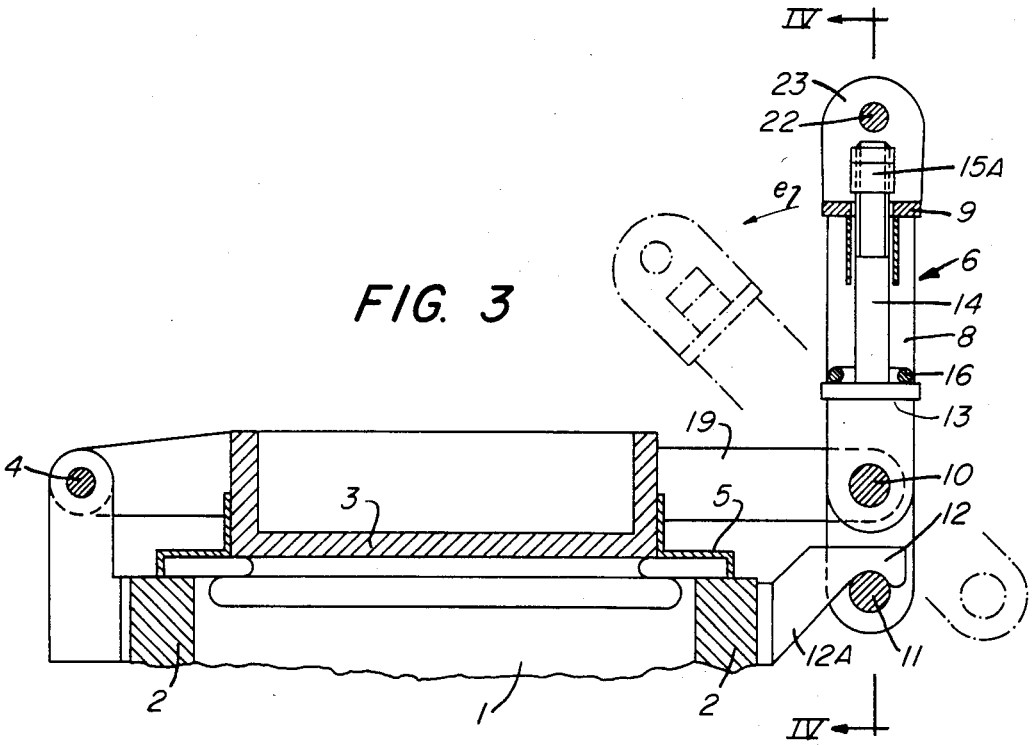
FIG. 3 is a sectional view through a leveling closure according to a second embodiment of the present invention.
Figure 4:
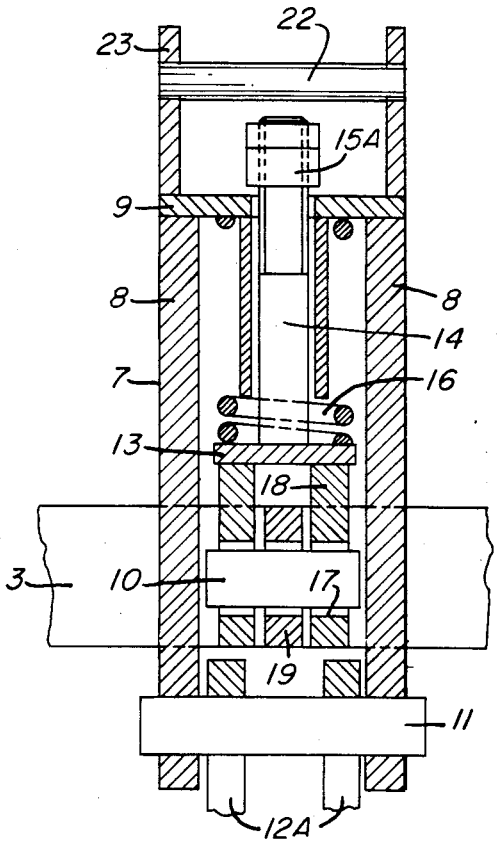
FIG. 4 is a sectional view taken along line IV—IV of FIG. 3.
Figure 5:
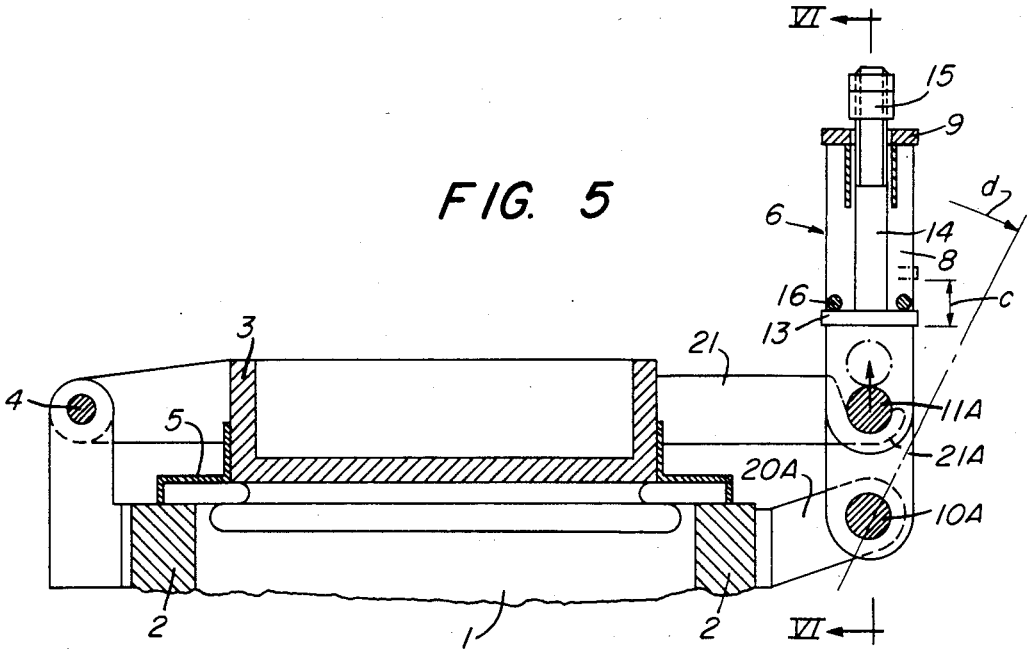
FIG. 5 is a sectional view through a leveling closure according to a third embodiment of the present invention.
Figure 6:
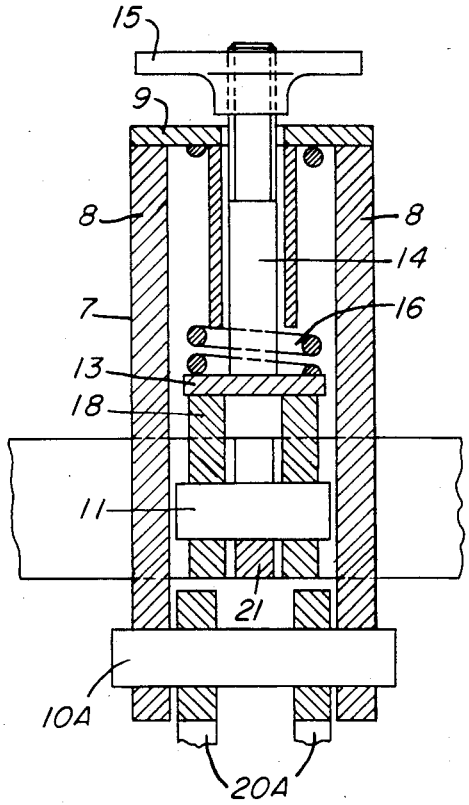
FIG. 6 is a sectional view taken along line VI—VI of FIG. 5.

The embodiment of the present invention shown in FIGS. 3 and 4 operates in a manner which is similar to the embodiment just described in regard to FIGS. 1 and 2. The reference numerals in FIGS. 3 and 4 which are the same as the numerals shown in FIGS. 1 and 2 denote the same elements. In FIGS. 3 and 4, nuts 15A are not butterfly nuts but comprise, for example, jam nuts. Two laterally-extending lugs 23 are provided on web 9. A pin 22 is secured to the lugs 23 and bridges the nuts 15A. An actuating element on the coke-pressing machine engages pin 22 and applies a force in a direction to rotate the latching means 6 from the solid-line, latched position shown in FIG. 4 to a phantom-line position in a direction indicated by arrow e. In this embodiment, the nuts 15A act as a stop member by serving to limit the travel of pin 14 under the force of spring 16 when the latching means is moved to an unlatched position. The same construction of parts of the latch means shown in FIGS. 3 and 4 can be used in the embodiment of the present invention shown in FIGS. 5 and 6. In FIGS. 5 and 6, a pivot pin 10A is secured to the bottom ends of flanges 8 of the latching means 6. The reference numerals in FIGS. 5 and 6 which are the same as reference numerals in FIGS. 1–4 identify like parts. Pin 10A cooperates with bores formed in the ends of an arm 20A which extends from the leveling box 2. A bolt 11A is supported by end portions of the retaining members 18. Latching claws 21 on the ends of arms 21A are connected to the leveling door 3 and have curved end portions that open upwardly as one views FIG. 5. The end portions of the latching claws are brought into cooperative engagement with the latching bolt 11A for latching the leveling door in a closed position as shown in FIG. 5.

The operation of the embodiment of the present invention shown in FIGS. 5 and 6 proceeds from the latched position shown in FIG. 5 by rotating the butterfly nut 15 in a direction to travel along the threaded portion of pin 14 toward web 9. Continued rotation of the butterfly nut moves plate 13 together with members 18 thereby lifting bolt in a direction indicated by arrow c until the bolt 11 is disengaged from the claw 21. The latching means 6 can then pivot about pin 10A in the direction indicated by arrow d. Latching of the door is carried out by performing the above sequence in reverse.

While I have shown and described herein certain embodiments of my invention, I intend to cover as well any changes or modifications therein which may be made without departing from its spirit and scope.

We claim as my invention:

1. Apparatus for latching a leveling door to close a leveling rod opening surrounded by a seal in a leveling box at the upper portion of a coke oven door, said apparatus including the combination of:

a U-shaped latching means having a cross web joining together ends of spaced apart side flanges, a spring plate movable between said flanges in a direction of the length thereof relative to the cross web, an actuating pin connected to said spring plate for extending through an aperture in the cross web, a stop member threadedly engaged with an end portion of said actuating pin which projects from the spring plate, a compression spring extending between said spring plate and said cross web, a first arm extending from said leveling door, a first pin for interconnecting said first arm and said spring plate, a second arm extending from said leveling box, a second pin for interconnecting said second arm and said side flanges, one of said first and second arms having a locking claw for releasably engaging the pin thereof and the other of said first and second arms being pivotally connected by the pin thereof, and retaining members directly connected to said spring plate, said retaining members having extended end portions for supporting one of said first and second pins.

2. The apparatus according to claim 1 further including a non-displaceable bearing support for pivotally interconnecting said first arm and said first pin.

3. The apparatus according to claim 1 further including a non-displaceable bearing support for pivotally interconnecting said second arm and said second pin.

4. The apparatus according to claim 1 wherein said first arm defines said locking claw.

5. The apparatus according to claim 1 wherein said second arm defines said locking claw.

6. The apparatus according to claim 1 wherein the extended end portions of said retaining members include bores to receive one of said first and second pins.

7. The apparatus according to claim 1 wherein said stop member comprises a butterfly nut.

8. Apparatus for latching a leveling door to close a leveling rod opening surrounded by a seal in a leveling box at the upper portion of a coke oven door, said apparatus including the combination of:

a U-shaped latching means having a cross web joining together ends of spaced apart side flanges, a spring plate movable between said flanges in a direction of the length thereof relative to the cross web, an actuating pin connected to said spring plate for extending through an aperture in the cross web, a stop member threadedly engaged with an end portion of said actuating pin which projects from the spring plate, a compression spring extending between said spring plate and said cross web, a first arm extending from said leveling door, a first pin for interconnecting said first arm and said spring plate, a second arm extending from said leveling box, a second pin for interconnecting said second arm and said side flanges, one of said first and second arms having a locking claw for releasably engaging the pin thereof and the other of said first and second arms being pivotally connected by the pin thereof, retaining members directly connected to said spring plate, said retaining members having extended end portions for supporting one of said first and second pins, and connection means extending from said cross web beyond said end portion of said actuating means about one of said first and second pins.

9. The apparatus according to claim 8 wherein said second arm defines said locking claw.

* * * * *